US005135249A

United States Patent [19]

Morris

[11] Patent Number: 5,135,249

[45] Date of Patent: Aug. 4, 1992

[54] SNOWBOARD HAVING A SHAPED BOTTOM SURFACE FOR STABILITY

[76] Inventor: James K. Morris, 312 N. Stadium Way, Apt. 402, Tacoma, Wash. 98403

[21] Appl. No.: 558,655

[22] Filed: Feb. 7, 1991

[51] Int. Cl.[5] ..... A63C 5/044

[52] U.S. Cl. ..... 280/609; 280/14.2; 280/28; D21/229

[58] Field of Search ..... 280/14.2, 18, 18.1, 280/609, 601, 608, 14.1, 28, 600, 606, 607; 441/74; D12/8, 10, 11; D21/228, 229

[56] References Cited

U.S. PATENT DOCUMENTS

| | | | |
|---|---|---|---|
| D. 170,888 | 11/1953 | Paden et al. | 280/18 X |
| D. 192,832 | 5/1962 | Forseth | D21/228 |
| D. 232,164 | 7/1974 | Bemis et al. | D12/10 |
| D. 255,820 | 7/1980 | Borden et al. | 280/14.2 X |
| D. 287,746 | 1/1987 | Whittaker | D21/229 |
| 1,872,230 | 8/1932 | Blake | 441/74 |
| 2,539,817 | 1/1951 | Ditter | 250/28 X |
| 3,147,020 | 9/1964 | Dahl | 280/18 |
| 3,343,847 | 9/1967 | Christy | 280/14.2 |
| 3,782,744 | 1/1974 | Milovich et al. | 280/18 X |
| 3,782,745 | 1/1974 | Stoveken | 280/18 |
| 3,879,047 | 4/1975 | MacDonald | 280/28 X |
| 4,083,577 | 4/1978 | Ford | 280/609 |
| 4,722,539 | 2/1988 | Molinaro | D12/10 X |
| 4,974,868 | 12/1990 | Morris | 280/609 |

FOREIGN PATENT DOCUMENTS

| | | | |
|---|---|---|---|
| 435061 | 10/1926 | Fed. Rep. of Germany | 280/609 |
| 3311779 | 10/1984 | Fed. Rep. of Germany | 280/18 |
| 3405987 | 8/1985 | Fed. Rep. of Germany | 280/609 |
| 3607808 | 9/1987 | Fed. Rep. of Germany | 280/14.2 |
| 2437850 | 4/1980 | France | 280/14.2 |
| 8806470 | 9/1988 | World Int. Prop. O. | 280/14.2 |

*Primary Examiner*—Andres Kashnikow
*Assistant Examiner*—Brian L. Johnson
*Attorney, Agent, or Firm*—Cassidy, Vance & Tarleton

[57] ABSTRACT

An improved snowboard (10) having a convex bottom (44) with a flat area (28) formed therein to extend from the tail (16) to at least the nose (18) to facilitate balancing of the snowboard (10) and improve performance when cornering. An improved snowboard (23) illustrates the convex bottom (36) smoothly tapering into the body 34 at the longitudinal midpoint (50) to form a flat bottom (52) that then extends to the tip (44). To provide additional control and stability, a keel (56) extends from the flat bottom (52) a distance no further than the convex bottom (36) and having a width between 2% and 4% of the width of the body (34).

3 Claims, 1 Drawing Sheet 24
20
12
18
26
2
10
2
14
28
16

10
12
22
20
14
30
28
30

32
38
46
48
34
36
54
58
56

44
38
4
46
42
32
56
4
52
50
54
34
40
36

SNOWBOARD HAVING A SHAPED BOTTOM SURFACE FOR STABILITY

TECHNICAL BACKGROUND

The present invention pertains to boards for carrying one or more riders on snow, and, more particularly, to a snowboard having an improved bottom to increase board stability on snow.

BACKGROUND OF THE INVENTION

The modern sport of snowboarding has evolved from barely-controllable foot sleds to precision-designed snowboards having controllability similar to much narrower snow skies. With both feet in an angled tandem stance in the bindings, a rider uses a combination of weight shifting and rotational turning to maneuver a snowboard down a snow-covered slope. Frequently, the rider shifts weight laterally to rock the snowboard over to one side or the other, especially when cornering.

To facilitate rocking of the snowboard laterally, some snowboards have bottoms that have a convex cross-sectional shape. A disadvantage to this arrangement is that it is difficult for a rider to maintain balance on the snowboard as it is rocking laterally on the convex bottom. This can be dangerous for the inexperienced rider who could lose control and collide with an object or another snowboard rider.

One proposed method for increasing controllability of a snowboard, particularly on hard packed snow, is disclosed in U.S. Pat. No. 3,782,744, issued to Milovich et al. on Jan. 1, 1974. The snowboard is disclosed as having a flexible stabilizing skeg longitudinally formed along the bottom surface of the board. A pair of resilient flexible pillars hold the skeg, which is formed of ¼ inch by 1½ inch aluminum, away from the central part of the bottom surface of the board approximately 1½ inches. This arrangement has several disadvantages. First, the large size of the skeg creates large amounts of drag, especially in hard packed snow, thus significantly reducing the speed of the snowboard. Another disadvantage is that the skeg will tend to ride on top of the hard packed snow due to the large width of the skeg. Finally, the large gap between the bottom of the board and the skeg and the resilient pillars placed in the gap further increases drag as the board passes through the snow. Hence, there is a need for an improved snowboard that has a convex bottom with increased stability and a keel that gives greater control and does not increase drag and reduce the speed of the snowboard.

SUMMARY OF THE INVENTION

The present invention is directed to an improved snowboard having a modified bottom to increase stability on snow. The improved snowboard comprises an elongate body having a top, bottom, a pair of mutually opposed sides, and a nose portion and a tail portion integrally therein. The bottom has a convex cross-sectional shape from side to side, with the convex bottom further including a flat area integrally formed therein that is parallel to the top surface of the board to facilitate a smooth ride and reduce unwanted rocking of the snowboard from side to side when it is ridden on a surface of snow.

In accordance with another aspect of the present invention, the flat area is positioned at the transverse midpoint of the bottom and extends at least partially along the length of the bottom parallel to the longitudinal axis of the elongate body. Preferably, the flat area extends from the tail portion to the nose portion.

In accordance with another aspect of the present invention, the improved snowboard has the flat portion formed therein with a width that is in the range of 8 percent to 16 percent of the width of the body.

In accordance with yet another aspect of the present invention, the bottom has a convex cross-sectional shape from the tail portion to approximately the longitudinal midpoint of the body. At that point, the convex bottom then smoothly tapers into the body to form a substantially flat bottom surface that extends from the taper to the nose portion of the snowboard body.

In accordance with a further aspect of the present invention, the snowboard also includes keel projecting from the flat area on the bottom a distance in the range ¼ inch to ⅜ inch. More preferably, the keel projects from the substantially flat bottom surface a distance that is equal to or less than the distance at which the convex bottom projects from the substantially flat bottom surface. In other words, the keel at the forward half of the bottom does not project lower than the plane of the convex bottom at the rearward half of the bottom.

In accordance with yet another aspect of the present invention, the keel is integrally formed with the body and smoothly tapers into the bottom at the longitudinal midpoint of the body and at the nose portion.

As will be readily appreciated from the foregoing description, the improved snowboard formed in accordance with the present invention utilizes a modified bottom having a convex cross-sectional shape to achieve increased lateral stability. The flat area or pad provides a small planar surface in which the rider can more easily balance the snowboard laterally while traveling over snow, eliminating unnecessary or unintentional rocking of the snowboard. In addition, the narrow keel projecting downward at the forward half of the bottom surface of the snowboard prevents over steering and over correction when the snowboard is being ridden on the snow surface, particularly on the surface of hard packed snow. Because the keel is relatively small, it produces less drag and allows the rider to have greater control without sacrificing speed.

BRIEF DESCRIPTION OF THE DRAWINGS

The foregoing and other features and advantages of the present invention will be more readily appreciated as the same becomes better understood from the detailed description when taken in conjunction with the following drawings, wherein.

DETAILED DESCRIPTION OF THE PREFERRED EMBODIMENT

Figure 1:
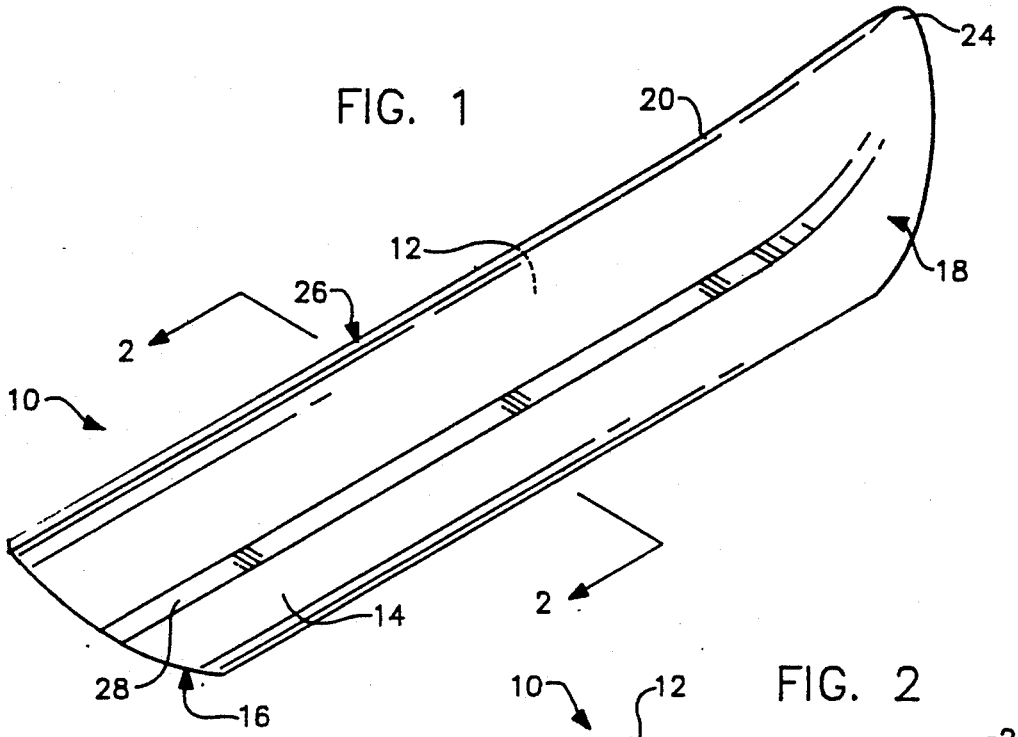
FIG. 1 is a bottom isometric view of an improved snowboard formed in accordance with the present invention.

Referring initially to FIG. 1, an improved snowboard 10 is shown having a top 12, a bottom 14, a tail 16 at one end, a nose 18 at the other end, and a first side 20 and a second side 22 that are substantially orthogonal to the top 12 and bottom 14. The nose 18 is upwardly curved with the first and second sides 20 and 22 meeting together at a tip 24. The dimensions of most commercially available snowboards, as described above, are approximately 4.5 feet in length, 1 foot wide, with the central portion of the body 26 being approximately 2 to 2.5 feet long.

Figure 2:
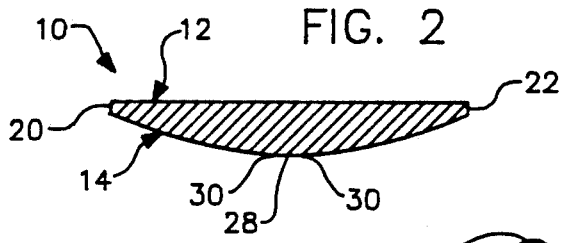
FIG. 2 is a cross-sectional view taken along lines 2—2 of the improved snowboard of FIG. 1.

As shown more clearly in FIG. 2, the cross sectional view shows the bottom 14 as having a convex cross-sectional shape from the first side 20 to the second side 22. The convex shape extends at least partially along the length of the bottom 14, and, more preferably, as shown in the representative embodiment extends from the tail 16 up to the tip 24. The degree of convexness may vary according to the needs of the rider and the desired performance.

The convex bottom 14 permits a rider to rock laterally from side to side on the snowboard to aid in turning the snowboard to the desired direction. Because it is difficult for a rider to balance the snowboard on a convex bottom, the bottom 14 of the snow-board 10 has a flat area 28 integrally formed therein. Ideally, the flat area 28 is formed to lie in a plane that is parallel to the plane of the top 12 of the snowboard 10. In addition, the flat area 28 is formed to be positioned at the transverse midpoint of said convex bottom and extends at least partially along the length of said bottom 14 parallel to the longitudinal axis of said body 26. In the embodiment depicted in FIG. 1, the flat area 28 extends from the tail 16 all the way into the tip 24. However, it is to be understood that the flat area 28 can be terminated prior to the tip 24, as will be described more fully below in connection with FIG. 3. Preferably, the width of the flat area 28 is 8% to 16% of the width of the snowboard 10, or approximately 1 inches to 2 inches wide. Any width beyond the maximum specified above would result in a rider falling off the snowboard 10 when trying to turn because the snowboard 10 could stumble over a sharp corner formed at the intersection of the flat area 28 and the convex bottom 14, as illustrated by reference number 30 in FIG. 2.

It is to be understood that the snowboard 10 may be formed from a single substance, such as wood, or, as is the current practice in the industry, the snowboard 10 may be formed from a plurality of fiberglass laminates built around a core of polyurethane or wood. It is contemplated that the current invention would be suitable for use with other methods of forming a snowboard that are yet to be developed.

Figure 3:
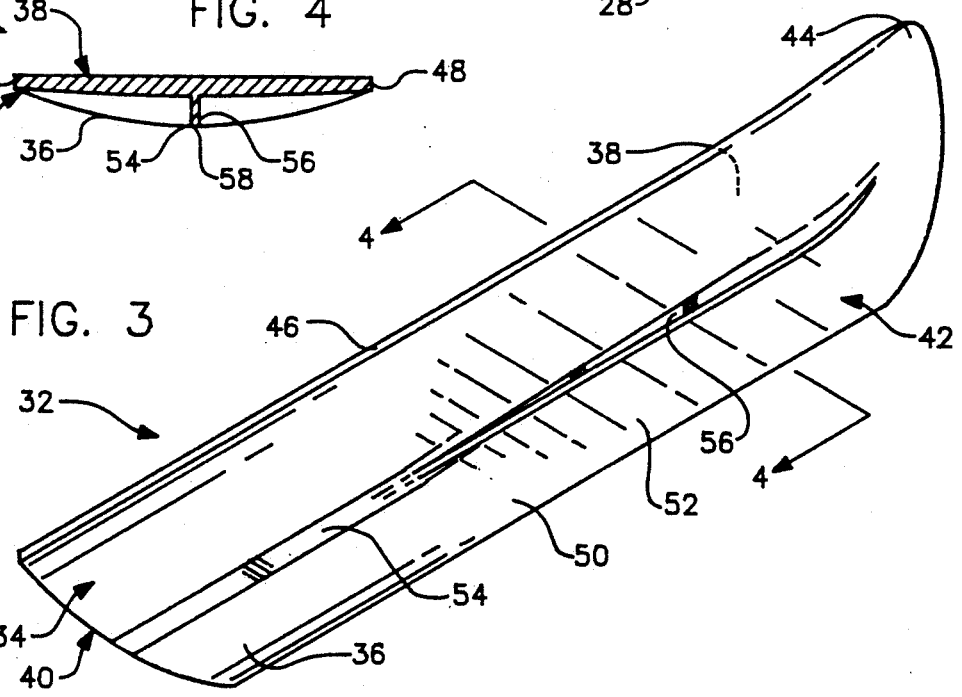
FIG. 3 is a bottom isometric view of an alternative embodiment of the improved snowboard formed in accordance with the present invention.

FIG. 3 illustrates an alternative embodiment of the present invention wherein an improved snowboard 32 is illustrated to have an elongate body 34 with a convex bottom 36, a top 38, a tail portion 40, a nose portion 42 with an upwardly curved tip 44 formed integrally therewith, and a pair of mutually-opposed sides 46 and 48 that meet at the tip 44 at the top of the nose portion 42. The convex bottom 36 maintains its shape from the tail portion 40 to approximately the longitudinal midpoint 50 of the body 34 where the convex bottom 36 then smoothly tapers to a flat bottom 52 that extends to the longitudinal midpoint 50 to at least the nose portion 42, and more preferably to the tip 44. A flat area 54 identical to the flat area 28 described in conjunction with FIG. 1 is also formed in the convex bottom 36 of the snowboard 32 illustrated in FIG. 3. The flat area 54 extends from the tail portion 40 to the longitudinal midpoint 50 of the body 34 where it then tapers into the flat bottom 52. Thus, the embodiment illustrated in FIG. 1 could be formed to have the convex bottom 14 taper to a flat bottom at approximately its longitudinal midpoint as illustrated in FIG. 3. This forms a rear pad having a planing surface or flat area 54 that permits a rider to transfer weight to the tail portion 40 of the snowboard 32 as the rider rocks from side to side when steering.

Figure 4:
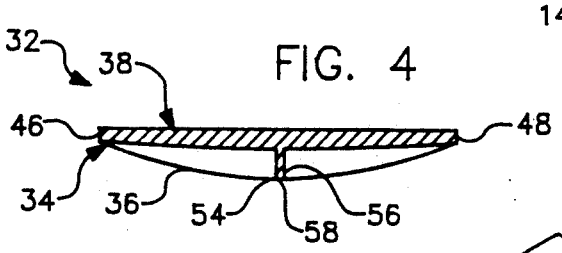
FIG. 4 is a cross-sectional view taken along lines 4—4 of the alternative embodiment of the improved snowboard of FIG. 3.

Also illustrated in FIGS. 3 and 4 is a keel 56 extending downward from the flat bottom 52 of the snowboard 32 along the longitudinal axis of the snowboard 32. Preferably, the keel extends from the flat bottom 52 approximately ¼ inch to ¾ inches, and, regardless of the depth it extends, the keel 56 does not extend from the flat bottom 52 any further than the convex bottom 36 extends from the flat bottom 52. This is illustrated more clearly in the cross-sectional view of FIG. 4, where the bottom surface 58 of the keel is flushed with the flat area 54 formed in the convex bottom 36. In order to reduce drag, the keel 56 has a relatively narrow width, preferably in the range of 2% to 4% of the width of the board. In a typical board having a width of 1 foot, the width of the keel would then be approximately ¼ inch to ½ inch.

The keel 56 is formed in the flat bottom 52 to smoothly taper into the flat area 54 in the convex bottom 36. The keel 56 extends forward to the nose portion 42 where it then smoothly curves upward to taper into the tip 44. It is to be understood that the keel 56 may be formed to have a shorter length such that it terminates prior to the tip 44. The length of the keel 56 is determined in part by the needs of the rider and the desired performance of the snowboard 32.

While a preferred embodiment of the invention has been illustrated and described, it is to be understood that various changes may be made therein without departing from the spirit and scope of the invention. Consequently, the invention is to be limited only by the scope of the claims that follow.

The embodiments of the invention to which an exclusive property or privilege is claimed are defined as follows:

1. A snowboard, comprising an elongate body having a top, a bottom, a pair of mutually opposed sides, and a nose portion and a tail portion integrally formed therein, said bottom having a substantially convex cross-sectional shape, said convex bottom further including a flat portion integrally formed therein that is parallel to said top surface and is positioned at the transverse midpoint of said bottom and extends from said nose portion to said tail portion and is parallel to the longitudinal axis of said elongate body, said flat portion having a width in the range of eight percent (8%) to sixteen percent (16%) of the width of said body, said bottom having a substantially convex cross-sectional shape from said tail portion to the longitudinal midpoint of said body where said convex bottom then smoothly tapers into said body to form a substantially flat bottom surface that extends from said longitudinal midpoint to said tip to facilitate a smooth ride and reduce unwanted rocking of said body from side to side on a surface of snow.

2. A snowboard, comprising an elongate body having a top, a bottom, a pair of mutually opposed sides, and a nose portion and a tail portion integrally formed therein, said bottom having a substantially convex cross-sectional shape, said convex bottom further including a flat portion integrally formed therein that is parallel to said top surface and is positioned at the transverse midpoint of said bottom and extends from said nose portion to said tail portion and is parallel to the longitudinal axis of said elongate body, said flat portion having a width in the range of eight percent (8%) to sixteen percent (16%) of the width of said body and a keel projecting downward from a substantially flat bottom surface a distance in the range of ¼ inch to ¾ inch, said keel is integrally formed with said body along said bottom surface from the longitudinal midpoint of said body to said nose portion and smoothly tapers into said bottom surface at the longitudinal midpoint of said body and at said nose portion, said bottom having a substantially convex cross-sectional shape from said tail portion to the longitudinal midpoint of said body where said convex bottom then smoothly tapers into said body to form said substantially flat bottom surface that extends from said longitudinal midpoint to said nose portion to facilitate a smooth ride and reduce unwanted rocking of the body from side to side on a surface of snow.

3. The snowboard of claim 2, wherein said keel does not project below a lowermost plane of projection of said convex bottom at said transverse midpoint of said bottom.

* * * * *